United States Patent [19]

Pitzer

[11] Patent Number: 5,038,598

[45] Date of Patent: Aug. 13, 1991

[54] METHOD AND APPARATUS FOR PERFORMING SECONDARY OPERATIONS IN A PRESS

[76] Inventor: Gene Pitzer, 16745 Camellia Ct., Fraser, Mich. 48026

[21] Appl. No.: 579,144

[22] Filed: Sep. 7, 1990

[51] Int. Cl.[5] ..... B21J 7/24; B21J 7/28

[52] U.S. Cl. ..... 72/453.02; 72/453.1; 72/453.11; 72/435; 72/472

[58] Field of Search ..... 72/453.01, 453.02, 472, 72/436, 435, 453.1, 453.11, 453.08

[56] References Cited

U.S. PATENT DOCUMENTS 3,707,866 1/1973 Brauer ..... 72/453.11
4,321,818 3/1982 Bessho ..... 72/453.02

FOREIGN PATENT DOCUMENTS 43-20942 7/1968 Japan ..... 72/453
0132232 6/1986 Japan ..... 72/68
0484039 9/1975 U.S.S.R. ..... 72/436
0467193 6/1937 United Kingdom ..... 72/436

*Primary Examiner*—David Jones
*Attorney, Agent, or Firm*—John R. Benefiel

[57] ABSTRACT

A method and apparatus for conducting a secondary operation on a workpiece such as punching or flanging, after a primary forming operation has been completed while the workpiece is still in the press. The secondary operation is performed by discharging a volume of hydraulic fluid to a working cylinder at a selectively controlled point in the press cycle, the hydraulic fluid pressurized by compression of a volume of gas by the press during the primary operation, and thereafter released by a solenoid valve at the time the secondary operation is to be performed. A discharge cylinder is mounted to one of the dies and is engaged to cause the hydraulic fluid to be pressurized by compression of the gas during the downstroke of the press.

16 Claims, 5 Drawing Sheets

METHOD AND APPARATUS FOR PERFORMING SECONDARY OPERATIONS IN A PRESS

BACKGROUND OF THE INVENTION

This invention concerns forming of sheet material in a press, as by the use of dies. In such operations, it is sometimes necessary to perform additional steps on a workpiece after it is formed, such as piercing holes, forming flanges, etc.

This is traditionally done by transferring the workpiece into an additional die set configured to perform the secondary operation.

Such an approach is costly in terms of requiring additional dies, and also in the handling involved in moving the workpiece into a second die set.

While it would be possible to utilize separate power cylinders and tooling in the initial die for this purpose set, this approach would require external hydraulic and/or pneumatic lines to be installed, increasing the cost of the installation as well as the maintenance requirements of the equipment.

Another approach, as suggested in U.S. Pat. No. 3,858,427, is a mechanical cam operated secondary tooling driven by the press motion. This approach somewhat limits the operations able to be performed since the cam is directly controlled by the press motion. Also, the mechanism must be custom designed for each application, increasing its costs.

SUMMARY OF THE INVENTION

The present invention comprises an assembly for generating an operating force to perform a secondary operation at a selectively controllable time in the press cycle. The assembly allows a controllable force and motion to be produced, tailored to the requirements of the secondary operations.

The assembly includes a charging means having a volume of hydraulic fluid, and a working cylinder adapted to receive hydraulic fluid from the means under pressure upon opening of a control valve. Accumulator means are provided to develop compression of a volume of gas by operation of the press, the pressure thereof exerted on the hydraulic fluid of the charging means, causing flow of the fluid upon opening of a control valve to carry out the operation performed by the working power cylinder.

The working cylinder piston is returned to a retracted position by a volume of compressed gas upon release of the charging pressure, to force the volume of hydraulic fluid back to the charging means. The assembly is mounted to the lower die shoe as a self contained package.

In a first embodiment, the charging means includes a charging cylinder directly stroked by operation of the press, the hydraulic fluid compressing a volume of gas in an accumulator chamber. The hydraulic fluid is held under pressure by a control valve, which subsequently releases the hydraulic fluid to the working cylinder when the secondary operation is to be performed.

In a second embodiment, an accumulator cylinder containing a gas is moved by the press stroke, so that a piston rod element thereof exerts a pressure on a charging cylinder piston rod. The compression of the gas develops the stored energy for forcing a volume of hydraulic fluid into the working cylinder upon opening of a control valve. In this second embodiment, pressure regulator means enables selective adjustment of the stored energy to match the requirements of the particular secondary operation.

DETAILED DESCRIPTION

Figure 1:
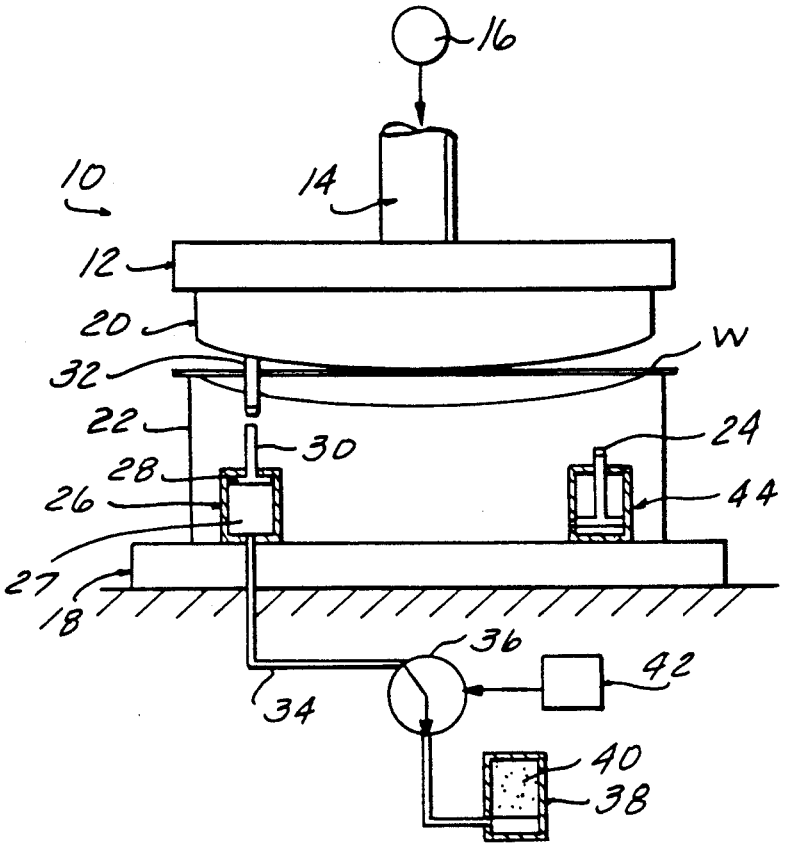
FIG. 1 is a diagram of a press and forming die, having apparatus according to a first embodiment of the present invention for performing a secondary operation on a workpiece, the press and apparatus shown in an initial condition.

In the following detailed description, certain specific terminology will be employed for the sake of clarity and a particular embodiment described in accordance with the requirements of 35 USC 112, but it is to be understood that the same is not intended to be limiting as the invention is capable of taking many forms and variations within the scope of the appended claims.

Referring to FIGS. 1–5, the method and apparatus according to the present invention concerns a press 10 having an upper platen 12 adapted to be driven downwardly by a ram 14 and an actuator 16 towards a lower platen 18 in the well known manner. An upper die 20 is forced against a lower die 22 to thereby form a workpiece W of sheet metal. The present invention concerns a secondary operation, as forming a local flange with tool 24 in the formed workpiece, after the primary forming operation has been completed.

In this embodiment, the invention includes a discharging cylinder 26 including a piston 28 having an upwardly directed piston rod 30 aligned with an engagement feature 32 fixed to the upper die 20. The piston 28 is driven down as the press is operated to cause the upper platen 12 and die 20 to descend towards the lower die 22. A volume of hydraulic fluid is contained in the cylinder space 27 beneath the piston 28, and is forced out as the piston 28 descends, flowing through passage 34 to a control valve 36. In the position shown, the valve 36 allows the hydraulic fluid to pass via passage 37 into an accumulator chamber 38, which contains a volume of gas, preferably nitrogen, in an interior chamber 40.

Figure 2:
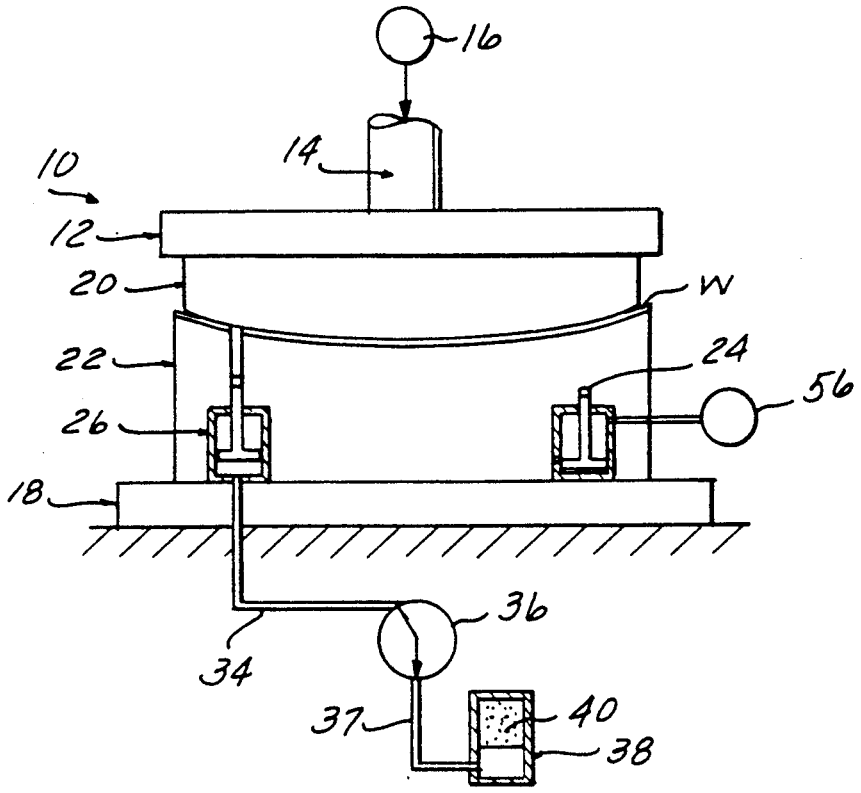
FIG. 2 is the diagram of FIG. 1 shown with the press advanced to stroke a charging cylinder included in the first embodiment of the invention.

As depicted in FIG. 2, as the flow of hydraulic fluid into chamber 40 occurs, this compresses the nitrogen gas, pressurizing the hydraulic fluid.

Figure 3:
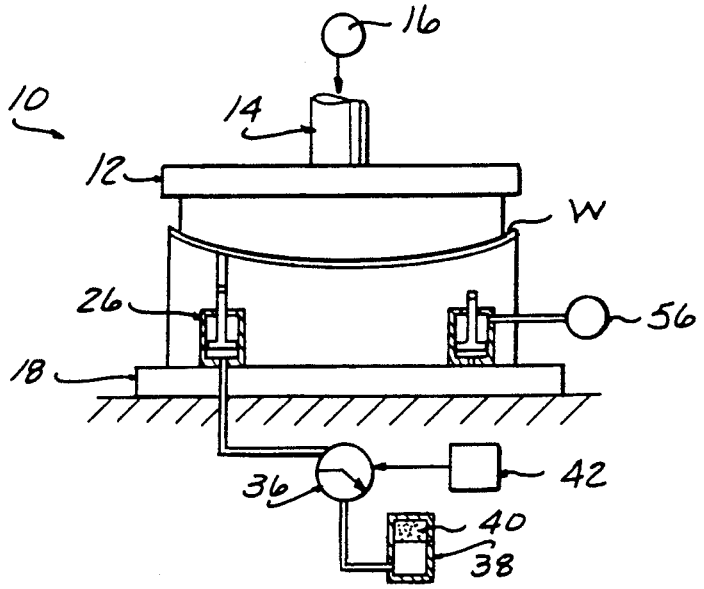
FIG. 3 is the diagram of FIGS. 1 and 2 shown with the accumulator charge held by the control valve included in the first embodiment of the invention.

As shown in FIG. 3 the valve 36 is thereafter operated, as by solenoid 42 to retain the pressurized hydraulic fluid.

Figure 4:
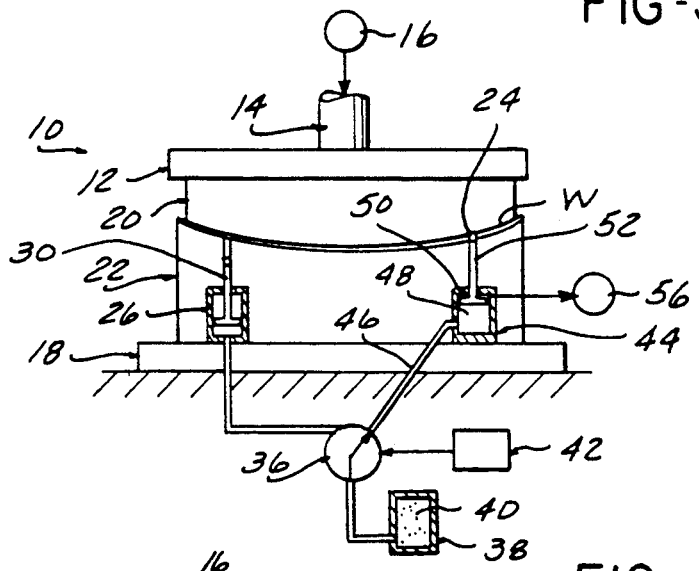
FIG. 4 is the diagram of FIGS. 1–3 with the control valve moved to allow discharge of hydraulic fluid to a working cylinder included in the apparatus according to the present invention.
Figure 5:
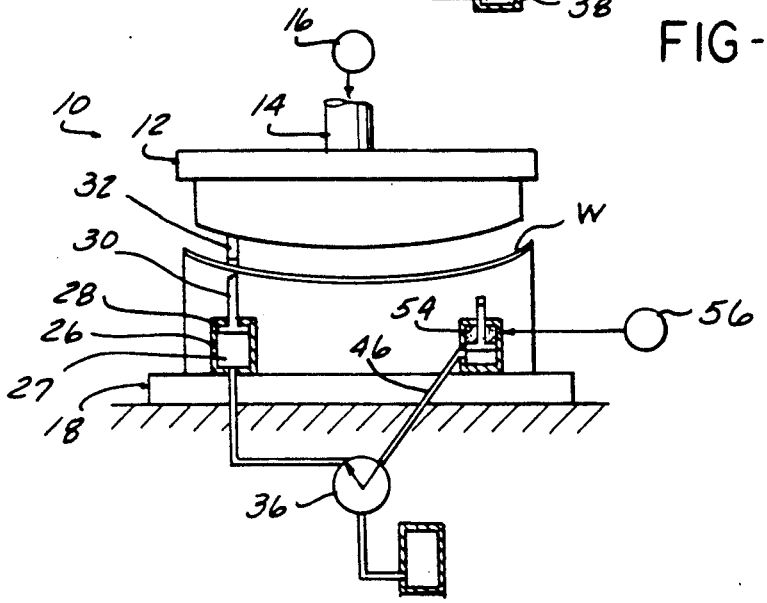
FIG. 5 is the diagram of FIGS. 1–4, with the control valve moved to allow the hydraulic fluid to be forced back to the charging cylinder.

In FIG. 4, the valve 36 is operated to cause the discharge of the hydraulic fluid under the pressure of the compressed nitrogen to a working cylinder 44, mounted to the lower die 18, via passage 46. The working cylinder 44 includes a chamber 48 beneath a piston 50 receiving the hydraulic fluid to drive the piston 50 upwardly. The piston 50 has a rod 52 attached thereto mounting the tooling 24, which accomplishes the secondary operation on the formed workpiece W.

The space 54 above the piston 50 contains nitrogen gas, and an external reservoir 56 is in communication with space 54 to increase the available volume of nitrogen in those instances in which close to the full stroke of the piston 50 is required to carry out the secondary operation. At the completion of the secondary operation, the valve 36 is operated to connect space 48 of working cylinder 44 to be in communication with space 32 of discharge cylinder 26. The compressed nitrogen gas in space 54 and reservoir 56 thus can drive the hydraulic fluid back into space 32 beneath the piston 28, again extending piston rod 30 to the full up position shown.

Figure 6:
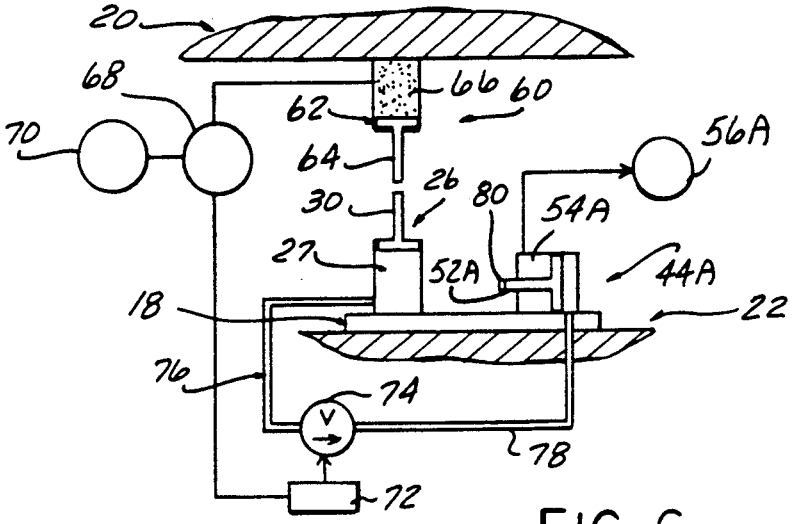
FIG. 6 is a diagram of a press having apparatus for performing a secondary operation according to a second embodiment of the invention installed therein, shown in the initial condition.
Figure 7:
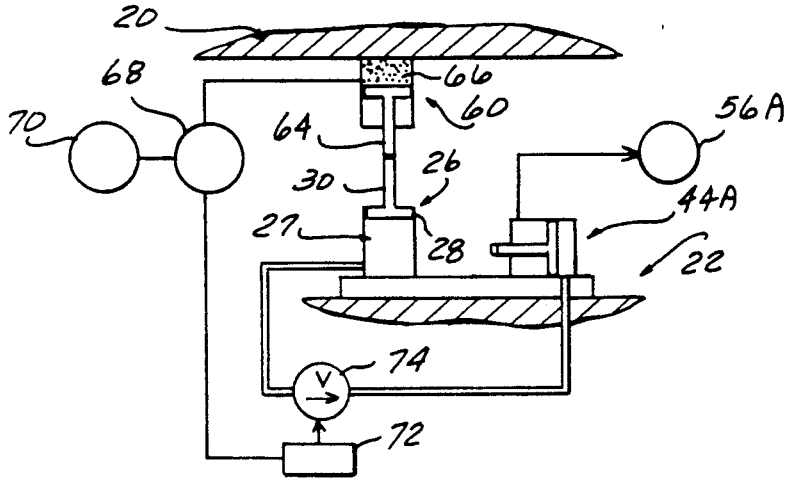
FIG. 7 is a diagram of the apparatus shown in FIG. 6 with the piston rod of an accumulator cylinder included in the apparatus engaging a piston rod of a charging cylinder by stroking of the press.
Figure 8:
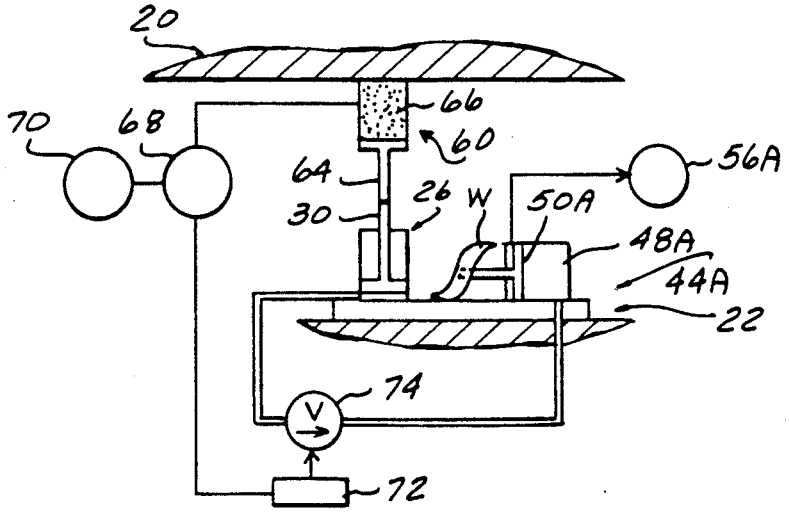
FIG. 8 is a diagram of the apparatus of FIGS. 6 and 7, with a control valve included in the apparatus moved to release hydraulic fluid under pressure from the accumulator cylinder to a working cylinder.

Instead of utilizing an accumulating chamber, accumulating means for generating stored pressure for acting on the hydraulic fluid from a charging cylinder, as in the above described embodiment, an accumulating cylinder 60 can be employed, as shown in FIGS. 6–8. The accumulating cylinder 60 is mounted to the upper die 20 so as to descend with the upper platen 12 of the press 10. The accumulator cylinder 60 includes a piston 62 and attached downwardly directed piston rod 64 aligned with the charging cylinder 26 so as to engage the upwardly directed piston rod 30 after a predetermined downward travel of the upper die 20.

The accumulating cylinder 60 has a space 66 above the piston 62 containing a gas, preferably nitrogen, charged via a regulator 68 and external reservoir 70, the regulator 68 controlled by a control circuit 72.

A solenoid valve 74, also activated by the control circuit 72 allows communication between chamber 32 of discharge cylinder 26 and chamber 48A of working cylinder 44A via passages 76, 78.

The working cylinder 44A is oriented transversely to the stroke direction of the dies 20, 22, as to be able to punch a hole in a formed rim with a punch 80 attached to the piston rod 52A.

The chamber 54A contains a gas, preferably nitrogen, and an external reservoir 56A may be employed to enable the full stroke of the working cylinder 44A to be used in the secondary operation.

Referring to FIG. 7, as the press is operated, and upper die 20 descends towards the lower die 22, the piston rod 64 of accumulating cylinder 60 engages the piston rod 30 of the discharge cylinder 26, pressurizing hydraulic fluid contained in chamber 32 beneath the piston 28. Continuing downward movement causes compression of the nitrogen in chamber 66, the compressed nitrogen constituting stored energy for operating the working cylinder 44A. The regulator can be controlled to precisely set the quantity of energy required for a particular operation.

Upon opening of the solenoid valve 74, after the primary forming operation is complete, the compressed nitrogen drives the piston 28 of the discharge cylinder 26 down, forcing the hydraulic fluid into chamber 48A of the working cylinder 44A, causing it to be stroked to carry out the secondary punching operation on the workpiece W, as shown in FIG. 8.

Figure 9:
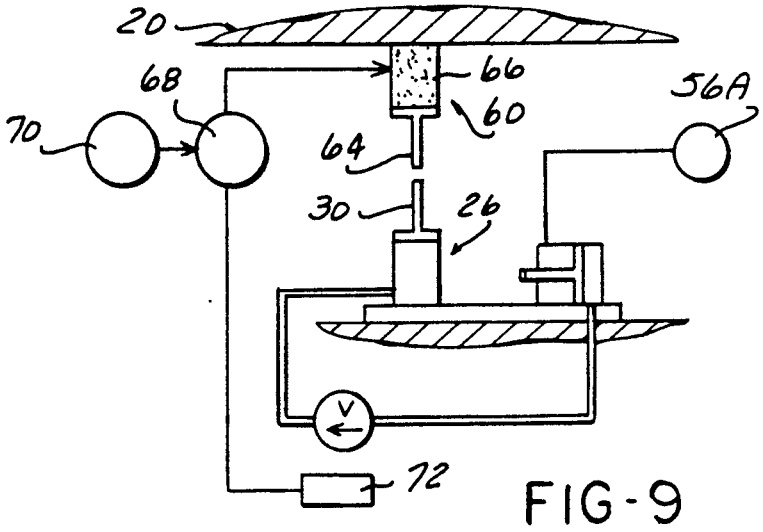
FIG. 9 is a diagram of the apparatus of FIGS. 6–8, with the hydraulic fluid shown returned to the charging cylinder by a volume of compressed gas acting on the working cylinder.

As the press is operated to move the upper die 28 away from the lower die 22, piston rods 64 and 30 separate, relieving the pressure on the hydraulic fluid. At this point the compressed nitrogen in chamber 54A and external reservoir 56A force the piston 50A to return, forcing the hydraulic fluid back into the chamber 32 of the discharge cylinder 32 thus raising the rod 30 to be ready for the next cycle, as seen in FIG. 9.

The various cylinders are preferably mounted in recesses formed in available spaces within the upper and lower dies 20, 22.

Figure 10:
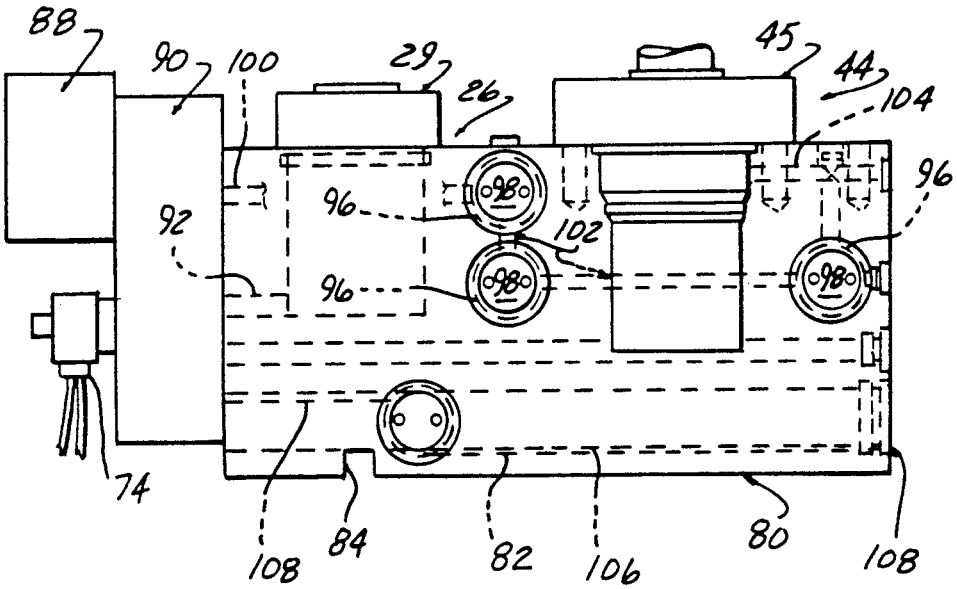
FIG. 10 is a side elevational view of an assembly according to the present invention.
Figure 11:
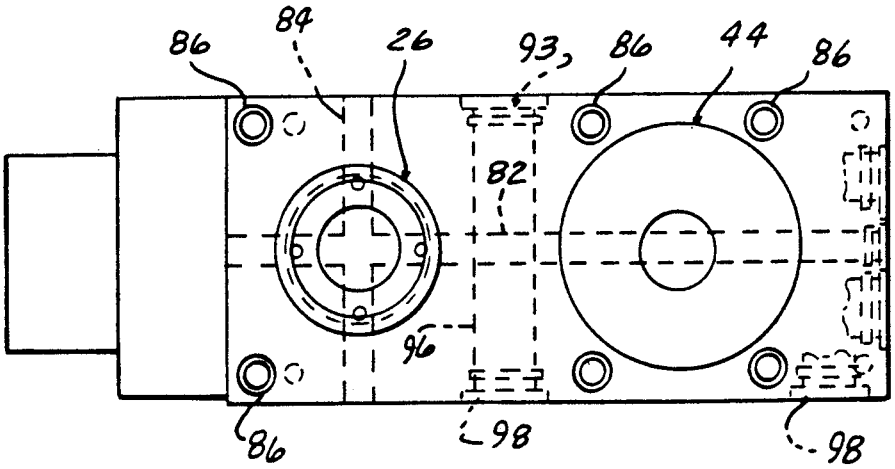
FIG. 11 is a plan view of the assembly shown in FIG. 10.

The cylinders and other components are preferably contained in a single assembly fixed to the lower die 22, as in the embodiment shown in FIGS. 10 and 11.

The cylinders 26 and 44 are contained in bores formed in a housing block 80. Caps 29, 45 close off the upper ends of cylinders 26 and 44.

The housing block 80 has transverse keyways 82, 84 for accurately fixing the same to the lower die 22, with mounting holes 86 provided to accommodate cap screws (not shown).

End pieces 88, 90 each house various control components and mount the solenoid valve 74, and are formed with internal passages accommodating the flow of hydraulic fluid to a from the valve 74. For example passage 92 extends from cylinder 26 while passage 94 extends to cylinder 44.

A series of transverse bores 96 closed with plugs 98 can be employed as the external reservoir 56 for containing compressed nitrogen gas, a pressure tap 100 enabling measurement of the pressure by a gauge (not shown), contained in housing 90. The bores 96 are interconnected via a network of passages 102 and communicated with cylinder 44 via passage 104.

A bore 106 closed with plug 108 can provide an external fill reservoir for the hydraulic fluid communicating via passage 108 with the discharging cylinder 26.

Thus, a self contained unit can be mounted to the lower die 22 to enable a secondary operation to be carried out in the same location where the primary workpiece forming is conducted.

Figure 12:
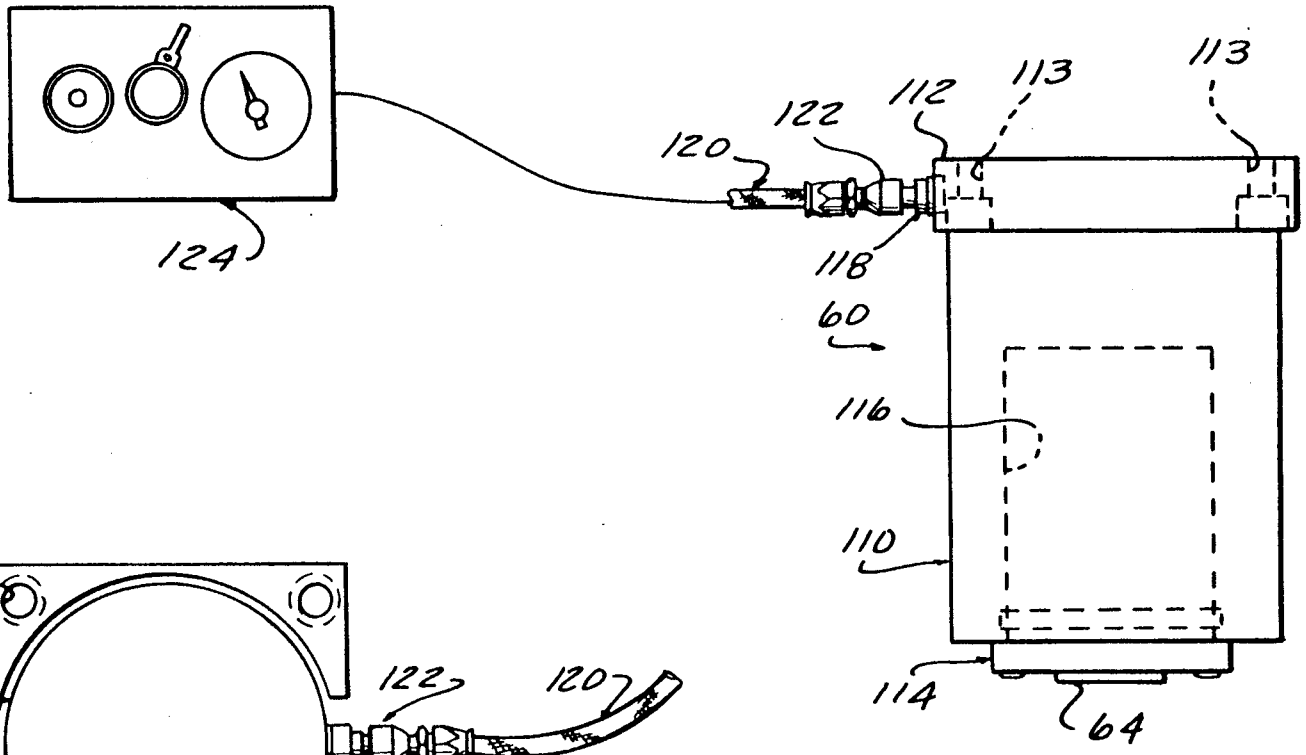
FIG. 12 is a side elevational view of an accumulator cylinder and connected regulator used in the apparatus of the second embodiment of the present invention.
Figure 13:
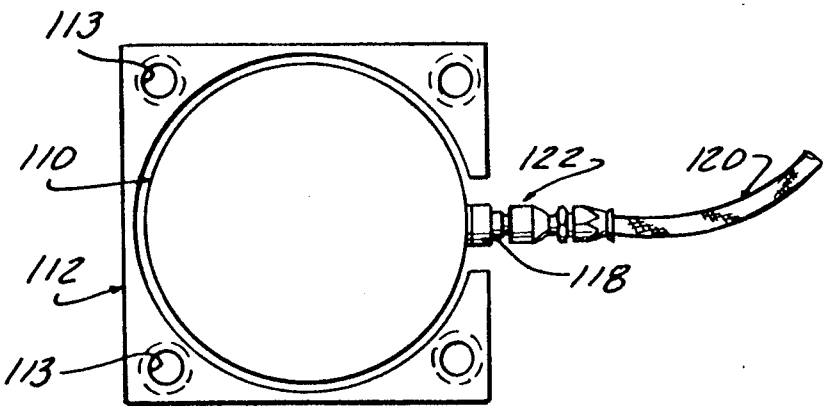
FIG. 13 is a plan view of the charging cylinder shown in FIG. 12.

FIGS. 12 and 13 depict the accumulator cylinder 60 including a cylinder housing 110 able to be mounted by means of a flange base 112 having a series of mounting holes 113. An end cap 114 closes off the open end of an internal bore 116.

A charging port 118 is connected to a high pressure hose 120 with fittings 122, connect to a regulator reservoir console 124.

It will be appreciated that the various cylinders must be relatively sized to enable the necessary stroke and force to be generated at the working cylinder to carry out the secondary operation performed.

Accordingly, an apparatus and method for carrying out a secondary operation has been provided which does not require plumbing connections and a separate hydraulic pneumatic power supply.

Also, the apparatus is very adaptable to allow use for a wide variety of forming cutting operations since the stroke and force way be readily adjusted to suit the particular application.

I claim:

1. A method of carrying out a secondary operation on a workpiece which has been formed in a primary operation by a press having movable platens and respective forming dies attached to each platen, said primary operation carried out by stroking of said press platens, said method comprising the steps of:

generating a pressurized volume of operating fluid by movement of said press platens during said primary forming operation;

progressively compressing a confined volume of a compressible fluid by continued movement of said press platens during said primary forming operation;

exerting the pressure of said compressed volume of compressible fluid on said pressurized volume of operating fluid;

after completion of said primary operation but before removal of said workpieces from said press, driving secondary tooling located within the press to perform said secondary operation with said pressurized volume of operating fluid using the stored energy of said compressed volume of fluid.

2. The method according to claim 1 wherein the step of progressively compressing the confined volume of compressible fluid includes the step of progressively compressing a confined volume of gas comprising said compressible fluid by direct application of the pressure of said operating fluid thereon operation of said press and exerting a pressure on said volume of hydraulic fluid by said compressed gas.

3. The method according to claim 2 wherein said step of compressing the confined volume of gas includes the step of positioning on one of said platens an accumulator cylinder containing said gas so as to engage a piston rod thereof with a piston rod of a discharge cylinder located on the other platen upon advancing movement of one or the other of said press platens, said discharge cylinder containing a volume of hydraulic fluid comprising the operating fluid beneath a piston connected to said piston rod.

4. The method according to claim 3 further including the steps of regulating the pressure of said compressed gas to adjust the level of stored energy generated by said press.

5. The method according to claim 1 wherein said secondary operation is carried out by directing said hydraulic fluid under pressure to a working cylinder carrying said secondary tooling at a selectively timed interval after completion of said primary operation.

6. The method according to claim 1 wherein said operating fluid is pressurized by stroking of a discharge cylinder located on one of said platens during operation of said press.

7. The method according to claim 6 wherein said discharge cylinder contains hydraulic fluid comprising said operating fluid, and said method includes the steps of forcing said hydraulic fluid into said confined volume of compressible fluid, said confined volume of compressible fluid comprising a sealed space containing a gas, said hydraulic fluid compressing said gas as said discharge cylinder is stroked.

8. The method according to claim 7 wherein said pressurized hydraulic fluid and compressed gas is held and thereafter released to a working cylinder carrying said secondary tooling to carry out said secondary operation by stroking of said working cylinder.

9. Apparatus for performing a secondary operation in a forming press having upper and lower platens moved towards each other by operation of the press to bring respective upper and lower dies located on said upper and lower platens into contact with a workpiece to perform a primary forming operation, the apparatus comprising:

a discharge cylinder mounted to move with one of said platens to extend towards the other platen, said cylinder including a piston and piston rod, a chamber beneath said piston containing an operating fluid;

means engaging said piston rod upon operation of said press and movement of said platens, said engagement of said discharge cylinder piston rod acting on said discharge cylinder piston to pressurize said operating fluid in said chamber;

accumulator means including a confined volume of a compressible fluid and means for progressively compressing said volume of fluid responsive to the continued engagement of said discharge cylinder piston rod to thereby create stored energy by operation of said press during said primary forming operation;

means for exerting said stored energy of said compressed confined volume of compressible fluid of said accumulator means on said pressurized operating fluid in said discharge cylinder chamber;

a working cylinder mounted within said forming press, said working cylinder having a piston rod, and tooling for conducting said secondary operation mounted on said working cylinder piston rod, said tooling located within said press to be engageable with said workpiece after primary forming thereof in said upper and lower dies but before removal of said workpiece from said press; said working cylinder including a piston attached to said working cylinder piston rod and defining a working chamber in said working cylinder; and, valve means for selectively allowing discharge of operating fluid under pressure in said discharge cylinder to be exerted in said working chamber of said working cylinder after forming of said workpiece in said upper and lower dies, timed, operation of said valve means causing said working cylinder piston to advance through a working stroke and to thereby cause said secondary operation to be conducted on said workpiece after primary forming of said workpiece in said upper and lower dies, said workpiece still located in said press during performance of said secondary operation thereon.

10. The apparatus according to claim 1 wherein said accumulator means comprises an external chamber containing said confined volume of compressed fluid, said volume of compressed fluid being a volume of gas said means for progressively compressing the volume of fluid being a direct application of the operating fluid of said discharge cylinder.

11. The apparatus according to claim 1 wherein said means for progressively compressing said volume of fluid in said accumulator means includes an accumulator cylinder mounted to the other press platen having a piston rod aligned with and facing said discharge cylinder piston rod so that said accumulator cylinder piston rod engages said discharge cylinder piston rod upon continued stroking of said press; a piston being attached to said accumulator cylinder piston rod and said compressible volume of fluid being located behind said accumulating cylinder piston to be compressed upon continued stroking of the platens of said press wherein said compressible volume of fluid is a volume of gas.

12. The apparatus according to claim 11 further including regulator means for controllably adjusting the pressure of said gas behind said accumulating cylinder piston.

13. The apparatus according to claim 1 further including an external space connected to a region within said working cylinder on the opposite side of said working cylinder piston from said working cylinder chamber to allow fluid communication therebetween, said external space filled with a volume of gas; said gas compressed by movement of said working cylinder piston during said working stroke to create a return force acting on said working cylinder piston.

14. The apparatus according to claim 1 wherein said operating fluid comprises a hydraulic fluid, and further including a return force means in said work cylinder acting on said working cylinder piston, and further including means for forcing said hydraulic fluid back into said discharge cylinder chamber after completion of said working stroke of said working cylinder.

15. The apparatus according to claim 1 further including a housing block attached to one of said upper or lower dies, said housing block having bores therein defining said discharge and working cylinders.

16. The apparatus according to claim 13 wherein said working cylinder is contained within a housing block, and wherein external space comprise one or more bores in said housing block, said housing block having passage means communicating said one or more bores within said working cylinder region.

* * * * *

UNITED STATES PATENT AND TRADEMARK OFFICE

CERTIFICATE OF CORRECTION

PATENT NO. : 5,038,598

DATED : August 13, 1991

INVENTOR(S) : Pitzer

It is certified that error appears in the above-identified patent and that said Letters Patent is hereby corrected as shown below:

Column 6, line 59 (Claim 9), after "timed" delete ",".

Signed and Sealed this

Nineteenth Day of January, 1993

*Attest:*

DOUGLAS B. COMER

*Attesting Officer*

*Acting Commissioner of Patents and Trademarks*